US007343638B2

(12) United States Patent
Mitchell et al.

(10) Patent No.: US 7,343,638 B2
(45) Date of Patent: Mar. 18, 2008

(54) CONNECTOR STRUCTURE FOR A PIVOTABLE HEAD

(75) Inventors: Michael Mitchell, Pleasanton, CA (US); German R. Gonzalez, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 726 days.

(21) Appl. No.: 10/877,247

(22) Filed: Jun. 25, 2004

(65) Prior Publication Data

US 2005/0283933 A1 Dec. 29, 2005

(51) Int. Cl.
*B25G 3/18* (2006.01)

(52) U.S. Cl. ..... 15/144.1; 15/172; 15/244.2; 16/900; 403/84

(58) Field of Classification Search ..... 15/144.1, 15/172, 244.2; 16/900; 403/84
See application file for complete search history.

(56) References Cited

U.S. PATENT DOCUMENTS 1,188,614 A * 6/1916 Bowen ..... 15/172
2,769,673 A * 11/1956 Valverde, Sr. ..... 403/92
3,491,397 A * 1/1970 Hesener ..... 15/118
3,704,480 A * 12/1972 Whitaker ..... 15/144.1
3,720,974 A * 3/1973 Rosendall ..... 15/144.1
4,455,705 A * 6/1984 Graham ..... 15/121
4,658,461 A * 4/1987 Roe et al. ..... 15/210.1
5,551,115 A * 9/1996 Newville ..... 15/172
5,593,460 A * 1/1997 Lessard ..... 15/143.1
6,058,551 A * 5/2000 Tagliavini ..... 15/172
6,546,584 B2 * 4/2003 Hobden ..... 15/144.1
2003/0233718 A1 * 12/2003 Heathcock et al. ..... 15/144.4
2005/0204497 A1 * 9/2005 Hillenbrand ..... 15/172

FOREIGN PATENT DOCUMENTS

DE 20303572 U1 * 5/2003
GB 846413 * 8/1960
JP 10-314094 * 12/1998

* cited by examiner

*Primary Examiner*—Mark Spisich
(74) *Attorney, Agent, or Firm*—David Peterson

(57) ABSTRACT

The structure of the present invention provides pivotable coupling of a head to a handle. The head may assume various pitch angles relative to the handle. Once place at a particular pitch angle the head is releasably fixed-in-place and opposes pitching of the head relative to the handle to assume a new pitch angle. With the application of sufficient force on the head, the head is released from the fixed-in-place pitch angle and a new pitch angle is achieved.

12 Claims, 10 Drawing Sheets

CONNECTOR STRUCTURE FOR A PIVOTABLE HEAD

BACKGROUND OF THE INVENTION

1. Field of the Invention

The present invention generally relates to cleaning implements. More particularly, the present invention relates to a cleaning implement head that releasable locks with a cleaning implement handle to maintain a fixed pivotal position of the cleaning implement head with respect to the cleaning implement handle during use of the cleaning implement.

2. Description of the Related Art

Cleaning implements that include a cleaning handle and an attached cleaning head have been available for some time. For example, traditional wet mops consisted of a handle and mop head, where the mop head is moistened with cleaning composition and then used to scrub hard surfaces, such as wood floors. Carpet sweepers have equally been available for some time. Carpet sweepers generally consist of a handle and sweeper mop head that uses the sweeping action to brush carpet soils into the sweeper head for later collection and disposal.

Lately new cleaning implements have been developed that may be used for dry or wet cleaning or both on hard surfaces. These implements consist of a handle and a connected head generally in the form of a flat plate to which a cleaning sheet or pad is attached. The sheet or pad may be dry, wet or wettable depending on the system or the desired use. An example of such an implement, which is useful for wet or dry cleaning, is Readimop® produced by The Clorox Corporation.

The most recent trend has been for these wet or dry cleaning implements to be made available to the consumer unassembled in parts. For example, certain cleaning implements were provided with segmented handles that were designed to be assembled by the user to form the completed handle. U.S. patent application Ser. No. 10/850,213, filed May 19, 2004 by Mitchell et al. is an example of this type of segmented handle, which is incorporated herein in its entirety. Further, the cleaning implement head was often provided unattached to the head end of the handle. The user attached the head to the handle before use of the cleaning implement. Providing the cleaning implement in this way permits the implement to be sold in a small store shelf sized box that may be more efficiently stocked than fully assembled cleaning implements. This provides two advantages, the first being relevant to the cost of packing and transporting the cleaning implements and the second being relevant to the convenience of the consumer in transporting the cleaning implement to their home.

One prior art method of assembling the head to the handle included screwing the head to a threaded end of the handle. Another prior art mechanism for assembling the cleaning head to the handle was to taper one end of handle at a certain draft angle. The tapered end of handle was then pushed in to a receiver hole or the interior of the hollow cylindrical portion or tube end of the head. The tube end of the head was not tapered or was tapered at a taper angle, sometimes referred to as a draft angle, greater than or equal to the draft angle of the head end of the handle. This provided for fitment of the handle into the aperture of the cleaning head.

Both of these mechanisms, however, result in a cleaning implement in which the cleaning head easily loosened or disassembled from the cleaning implement handle. For example, catching the cleaning head on a table leg and pulling often provide enough force to pull apart a tapered cleaning head to handle connection. Screw together mechanisms also easily loosened during use thereby weakening the head to handle connector.

Further, with prior art connectors, the head would often yaw, i.e., rotate about the central longitudinal axis of the handle, when the cleaning implement was in use. This yawing was especially disadvantageous in cleaning implements that had an ergonomic design, which relied on maintaining a fixed yawing rotational relationship of the cleaning head relative to the handle to provide efficient and effective gripping of the cleaning implement to avoid fatigue and strain during use. Cleaning heads that rotated about the handle did not maintain the specific ergonomic shape designed for the implement. For example, a handle may be designed to curve directly downward when the cleaning head is in contact with a horizontal surface. If the head rotates relative to the central axis of the handle, the curve of the handle skews left or right depending on the direction rotation of the head about the handle.

Still further, with threaded or tapered connectors, pivoting of the head about a handle lateral axis to pitch the head relative to the handle is not possible since the connects hold the head fixed laterally to the handle. To provide flexibility to pitch the head relative to the handle, a separate or integral pivot element, coupled to either the head or handle, was required. Further, pivot elements that allowed pitching of the cleaning head relative to the handle where often initially loose or became loose with wear. Thus, under these conditions, the head would often flop about back and forth and pitching up and down whenever the head has removed from a surface to which it was applied. The pitch of the head relative to the handle would change when the head was removed from the surface being cleaned. This made it more difficult to use the cleaning implement, and the pivot element and head to handle connector were stressed as the head pitched to readjust whenever the head was applied-removed-and-reapplied to the surface in a typical cleaning motion.

Thus, while there is a desire to provide cleaning implements that are convenient and adept at surface cleaning, there is a further need to provide these cleaning implement in a form that is both easy to ship and easy to assemble by a consumer. Still further, there is a desire to provide cleaning implements that facilitate proper assembly by a consumer and that are ergonomic and easy to use. Accordingly, there is currently a need for improved connector structures for coupling a cleaning implement head to a cleaning implement handle.

SUMMARY OF THE INVENTION

In accordance with the principles of the present invention, provided is a cleaning implement having a cleaning head pivotably coupled to a cleaning implement handle. In one embodiment, the cleaning implement is supplied unassembled with the cleaning head and handle being supplied as separate components. At assembly, in one embodiment, the head may be coupled to the handle in only one yawing orientation i.e., at assembly, the head is rotated about the central longitudinal axis of the handle to only one specific position where coupling of the head to the handle is possible. The present invention may be used with an ergonomically designed cleaning implement having a handle designed for a specific yawing orientation of the cleaning head.

After assembly, however, the head may pitch up or down relative to the handle. Further, the head maintains its last pitch angle with the handle if no force is imposed on the head. In one embodiment, the cleaning head is flexible and is configured in the form of a flat clothes ironing head having a front point.

In one embodiment, the cleaning head includes a handle connector element, and the handle includes a head connector element configured to cooperate together to pivotably couple the cleaning head to the handle. The handle connector element of the head includes a left and right yoke arm, each configured generally as a broad based post, spaced apart laterally on the top surface of the cleaning head. Coupled adjacent the top of left yoke arm is a left boss configured generally as a tapered frusto-conical segment having an exterior surface. The left boss is directed toward the right yoke arm and along a course generally parallel to the top surface of the cleaning head. Coupled adjacent the top of the right yoke arm is a right arm boss configured generally as another tapered frusto-conical segment having an exterior surface. The right boss opposes the left boss and is directed toward the left boss along a course generally parallel to the top surface of the cleaning head.

The head connector element of the handle includes opposing left and right receivers at the left and right sides of the handle at a head end portion of the handle. At assembly, the head end portion of the handle receives the cleaning head. The head end portion of the handle is opposite a gripper end portion of the handle that is used for grasping the cleaning implement.

The left and right receivers are apertures in the head end portion of the handle that have tapered conically shaped interior surfaces. The left and right receivers are adapted to receive the left and right bosses, respectively, and to establish abutting contact between respective boss exterior surfaces and receiver interior surfaces.

After coupling the head to the handle, the bosses are rotatable within the respective receivers thereby allowing the cleaning head to pitch up and down with respect to the handle.

In one embodiment, the bosses each include a flat boss base surface. The boss base surfaces are adjacent the ends of the respective bosses that are coupled to boss arms. Further, the receivers each include a flat receiver bottoming surface adjacent to and circumscribing the respective receivers at the outside surface of the handle. The boss base surfaces and the receiver bottoming surfaces are all configured generally as rings. The boss base surfaces are adapted to abuttingly contact respective receiver bottoming surfaces when the cleaning head is coupled with the handle of the cleaning implement at assembly.

As noted, after coupling of the head to the handle, the bosses are rotatable within the respective receivers allowing the cleaning head to pitch up and down relative to the handle. However, the abutting contact between respective boss exterior surfaces and receiver interior surfaces creates frictional force that opposes the rotation of the bosses within the receivers. Further, the abutting contact between the boss base surfaces and respective receiver bottoming surfaces also creates frictional force that opposes the rotation of the bosses within the receivers. Thus, after coupling the cleaning head to the handle, rotation of the bosses within respective receivers is opposed. Accordingly, the pitch angle of the head relative to the handle remains fixed absent application of a force to the cleaning head sufficient to overcome the friction forces create by the various abutting contacts of the connector elements.

The relative, size, shape, and configuration of the components making up the head connector elements of the handle and the handle connector elements of the head may be altered to provide alternate embodiments and additional aspects to the present invention.

BRIEF DESCRIPTION OF THE DRAWINGS

The foregoing aspects and others will be readily appreciated by the skilled artisan from the following description of illustrative embodiments when read in conjunction with the accompanying drawings, wherein.

Reference will now be made to the drawings wherein like numerals refer to like parts throughout.

DETAILED DESCRIPTION

In accordance with the principles of the present invention, provided is a cleaning implement having a cleaning implement head, sometimes referred to simply as a head, pivotably coupled to a cleaning implement handle, sometimes referred to simply as a handle. In one embodiment, the cleaning implement is supplied unassembled with the head and handle being supplied as separate components. At assembly, in one embodiment, the head may be coupled to the handle in only one yawing orientation i.e., after assembly, the head is not rotatable about the central longitudinal axis of the handle. The head may, however, pitch up or down relative to the handle. Further, the head maintains its last pitch angle if no force is imposed on the head. The present invention may be used with a tool such as an ergonomically designed cleaning implement having a handle designed for a specific orientation relative to the cleaning head.

Figure 1:
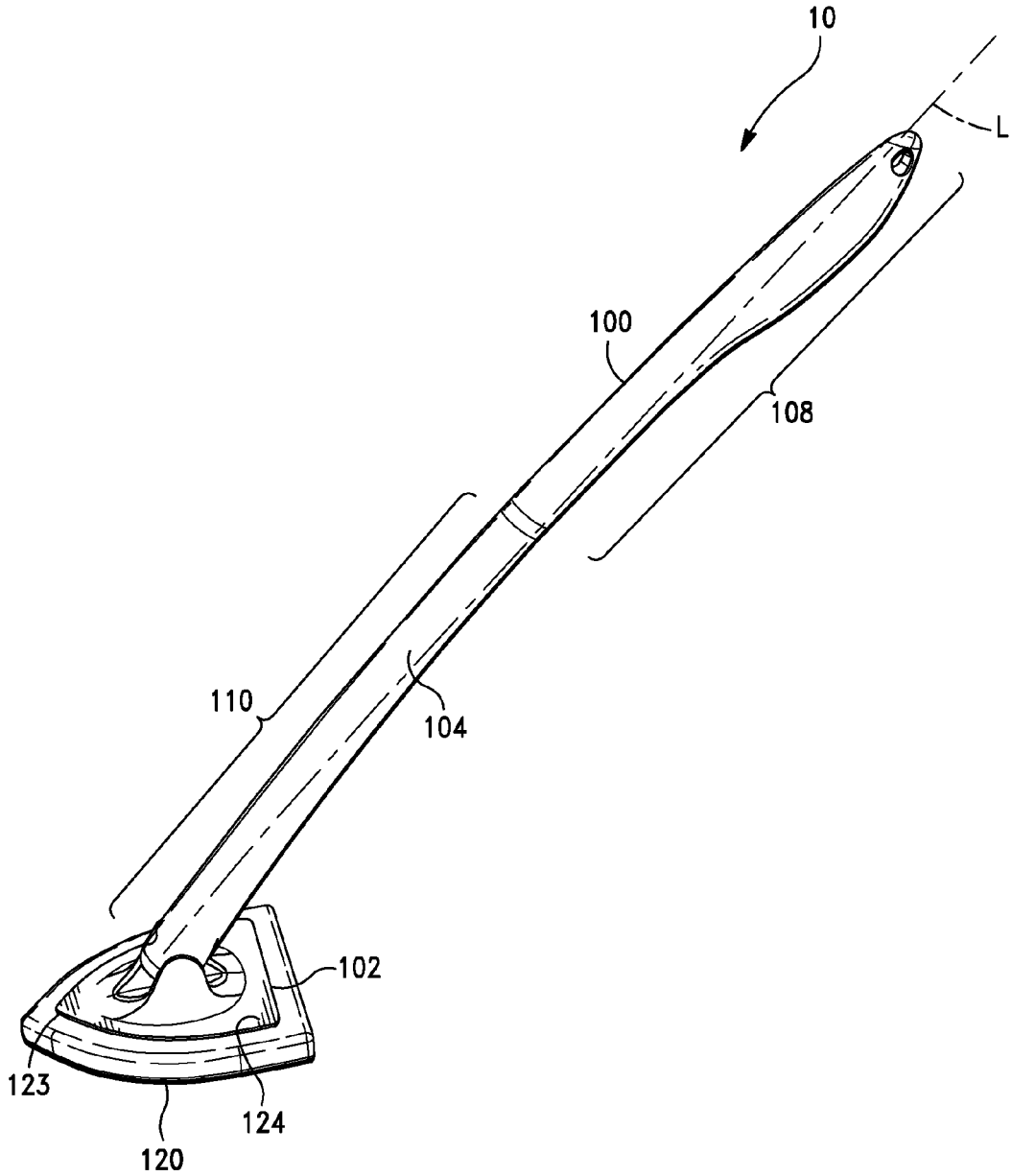
FIG. 1 is a perspective view, after assembly, of a cleaning implement, in accordance with the principles of the present invention, having a releasably fixed-in-place cleaning head pivotably coupled to one end of a handle.

More particularly, FIG. 1 is a perspective view, after assembly, of a cleaning implement 10, in accordance with the principles of the present invention, having a releasably locking (fixed in place) head 102 pivotably coupled to one end of a handle 100. In one embodiment, handle 100 is configured in a tubular or pipe-like shape having a cylindrical handle outside surface 104, a cylindrical handle inside surface 638 (FIG. 6), and a longitudinal axis L running lengthwise along handle 100. In other embodiments, handle 100 is solid and/or is configured in a shape other than cylindrical.

Handle 100 includes gripper end portion 108, distal from head 102, for manually grasping cleaning implement 10 by handle 100. Gripper end portion 108 of handle 100, is the part of handle outside surface 104 adjacent the upper end of handle 100 where cleaning implement 10 is grasped for use.

At the lower end of handle 100 opposite the upper end of handle 100 along central axis L, is a head end portion 110 of handle 100. Head end portion 110 is the part of handle outside surface 104 adjacent the lower end of handle 100 where head 102 is coupled to handle 100 at assembly of cleaning implement 10.

As described more fully below with reference to FIGS. 5A and 5B, head end portion 110 of handle 100 includes a head connector element 229 (FIG. 2) that is adapted to cooperate with a handle connector element 227 (FIG. 2) of head 102 to form a structure for coupling head 102 to handle 100. At assembly, head 102 is pivotably coupled to handle 100 by head connector element 229 of handle 100 in cooperation with handle connector element 227 of head 102. The pivotal coupling of head 102 with handle 100 allows head 102 to pitch up and down in relation to handle 100.

The directional terms "lower" and "upper", "left" and "right", "up" and "down", "pitch" and "yaw" and the like are used herein for ease of description in conjunction with the drawings. These terms are not meant to indicate that the structural components of the present invention must have a specific orientation except when specifically set forth below.

Also, more particularly in the embodiment shown in FIG. 1, head 102 is flexible and is configured as flat rectangular plate curving and tapering to a head point 123 at the front of head 102 in the manner of a clothes iron head. Head 102 has a head upper surface 124 most proximal handle 100, and a head lower surface 222 (FIG. 2) opposite head upper surface 124. In another embodiment, head 102 is generally round. Other configurations of cleaning head 102 are also possible without departing from the principles of the present invention.

A dry, wet, or wettable flexible cleaning pad 120 is releasably attached to head lower surface 222. The shape of cleaning pad cleaning pad 120 is generally congruent with the shape of head 102 but may extend beyond the outer edges of cleaning pad cleaning pad 120 in certain embodiments. Cleaning pad 120 may be coupled to head 102 by any releasable means, such as, Velcro® attachments, hooks, snaps, releasable adhesives, and the like, well known to those of skill in the art.

In use of cleaning implement 10 of FIG. 1, head 102 is pivotably coupled to handle 100 and cleaning pad 120 is releasably attached to head lower surface 222 (FIG. 2) of head 102. Cleaning pad 120 is then placed in contact with a hard surface, such as a wood floor or a tile fixture or stall, to scrub and clean the surface. The flexible characteristics of head 102 allow head 102, and, more particularly, cleaning pad 120, to conform to a curved hard surface, such as a tub or shower stall, to provide abutting contact between the cleaning pad cleaning pad 120 and the curved hard surface. Further, head point 123 of head 102 provides for cleaning of tight corners, bends, or points by allowing cleaning pad 120 to abuttingly contact these surface features.

Figure 2:
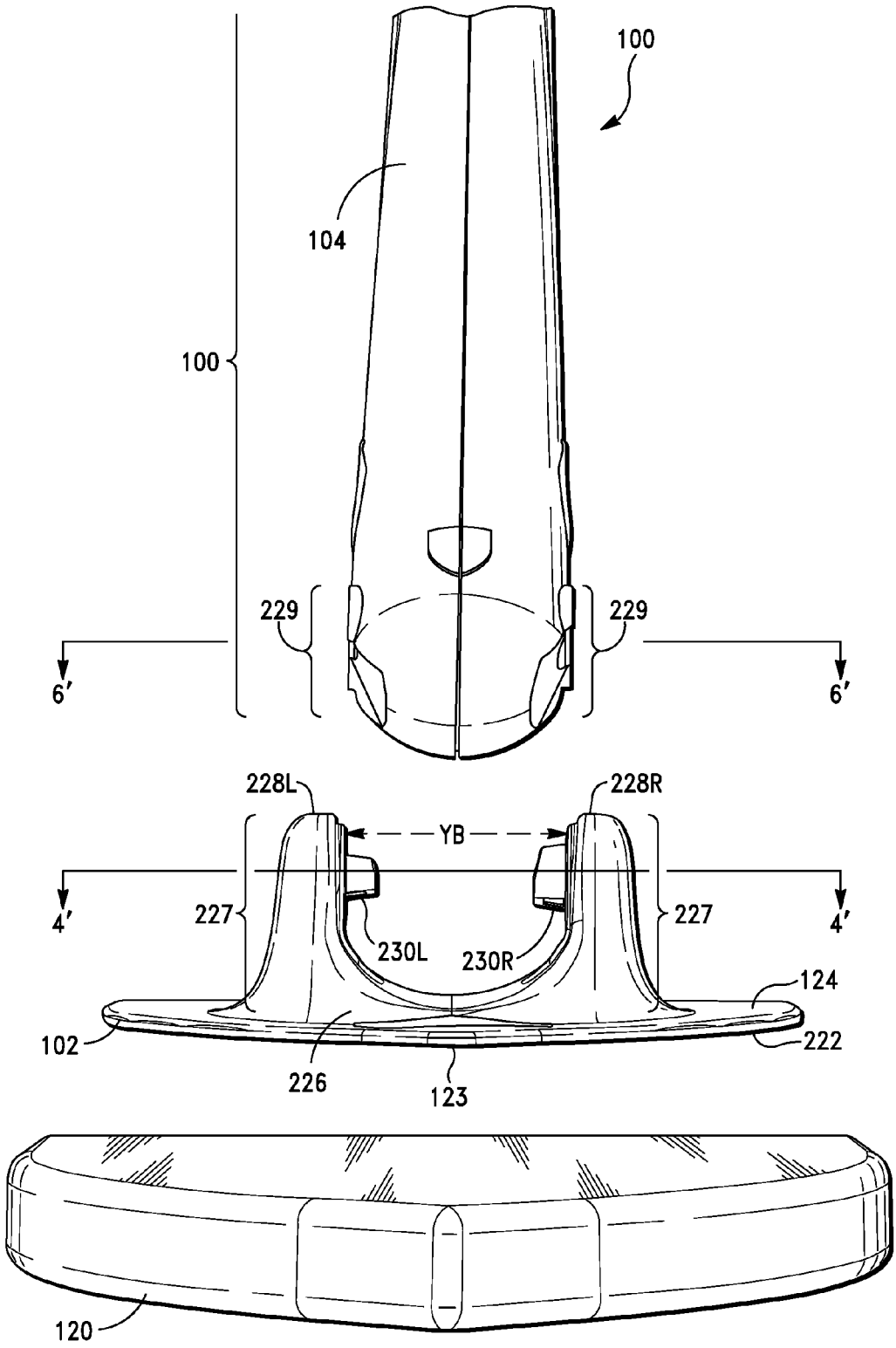
FIG. 2 is an exploded front view of one embodiment of the cleaning implement of FIG. 1.

The connector elements 227 and 229 for pivotably coupling head 102 to head end portion 110 at handle outside surface 104 of handle 100 are next described. FIG. 2 is an exploded front view of one embodiment of cleaning implement 10. Head 102 includes a handle connector element 227 that includes a "U" shaped yoke 226 coupled at the bottom segment of the "U" shape of yoke 226 to head upper surface 124 of head 102. The "U" shape yoke 226 is completed by a right arm 228R projecting upwardly from head upper surface 124 of head 102 and a left arm 228L, also projecting upwardly from head upper surface 124 and spaced apart a boss spacing distance XB (FIG. 2) laterally from left arm 228L. In one embodiment, left arm 228L and right arm 228R are each generally configured as a broad based posts making up the leg segments of the "U" shape of yoke 226.

Figure 3A:
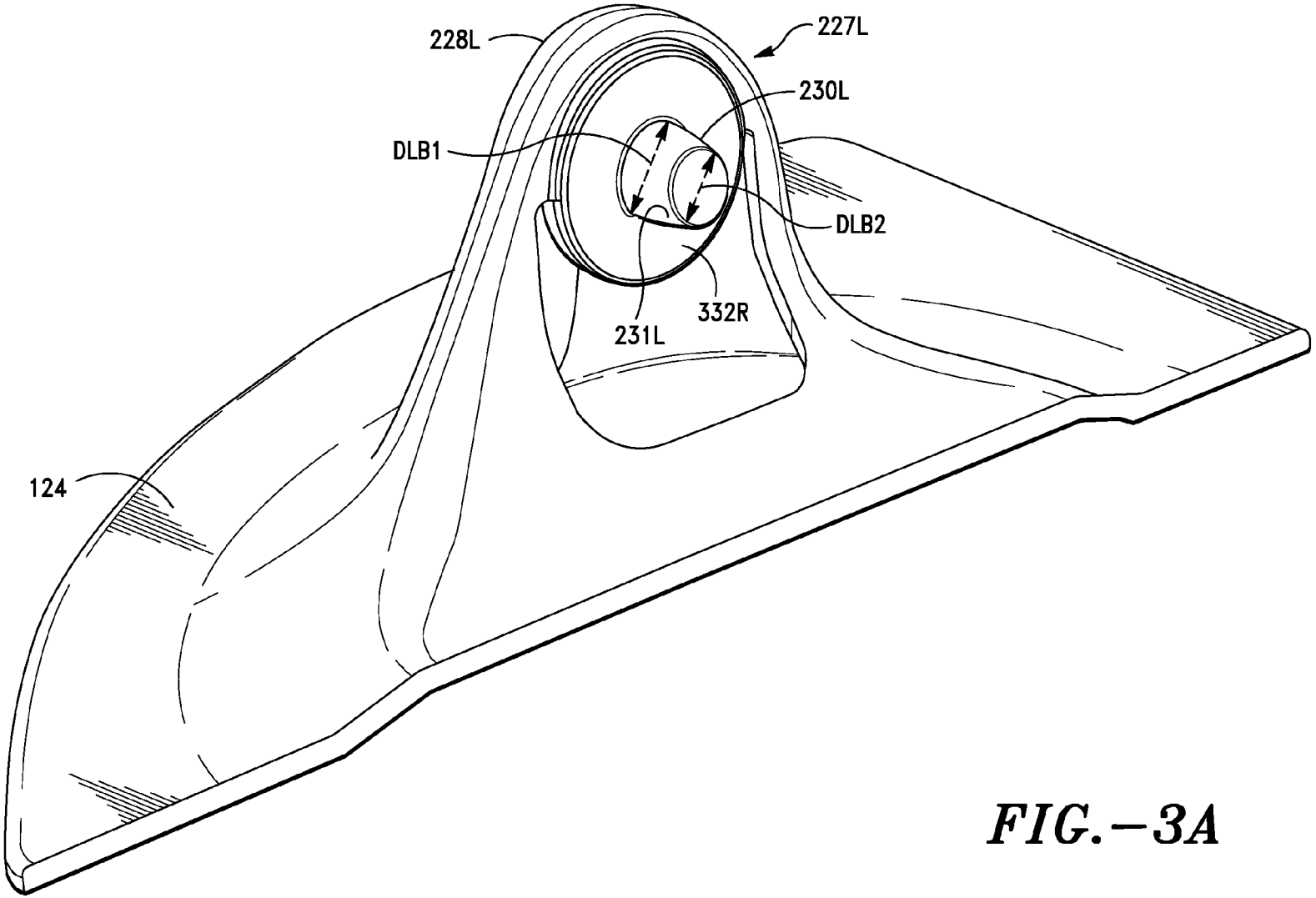
FIG. 3A is a perspective partial view of the head of FIG. 1 showing a left arm and a left boss.
Figure 4:
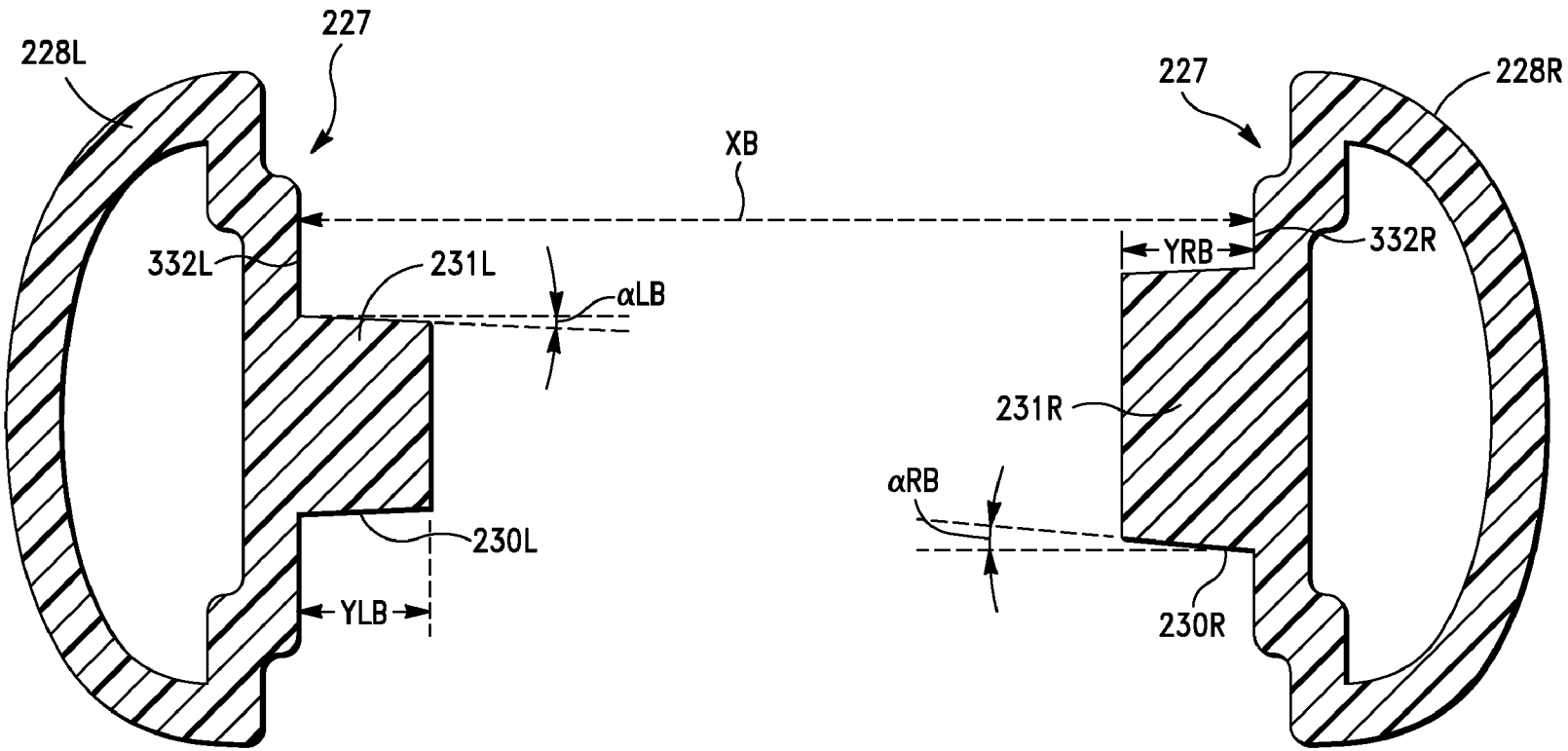
FIG. 4 is a cross-sectional view of cleaning head of the cleaning head taken along 4'_ 4' of FIG. 2.

Handle connector element 227 further includes a left boss 230L coupled adjacent the top of left arm 228L. FIG. 3A is a perspective partial view of head 102 showing left arm 228L and left boss 230L. FIG. 4 is a cross-sectional view of head 102 of cleaning implement 10 taken along 4'_ 4' of FIG. 2. Referring to FIGS. 2, 3A and 4 together, left boss 230L is configured as frusto-conically shaped, shaft-like, projection. Said another way, left boss 230L is formed as a uniformly tapered cone segment. Left boss 230L is directed along its frusto-conical axis (not shown) generally parallel to head upper surface 124 toward a right boss 230R (FIG. 2).

Left boss 230L has a left boss outer diameter DLB1 (FIG. 3A) at the cone segment end of left boss 230L where left boss 230L is coupled to left arm 228L. Left boss 230L further has a left boss inner diameter DLB2 (FIG. 3A) at the uncoupled free end of left boss 230L opposite the cone segment end of left boss coupled to left arm 228L. As shown, left boss outer diameter DLB1 is greater than left boss inner diameter DLB2. Thus, left boss 230L defines a frusto-conical segment having a left boss exterior surface 231L tapered at a left boss draft angle $\alpha$LB (FIG. 4). There is also a left boss length YLB, which measures the axial length of left boss 230L, i.e., the distance between the coupled and free ends of left boss 230L.

Handle connector element 227 further includes a left boss base surface 332L adjacent to and circumscribing the cone segment end of left boss 230L coupled to left arm 228L. Left boss base surface 332L (FIG. 3A) is formed as a planar surface, in the shape of a flat ring, facing inwardly toward right arm 228R, and generally along the same course as the conical axis of left boss 230L.

Figure 3B:
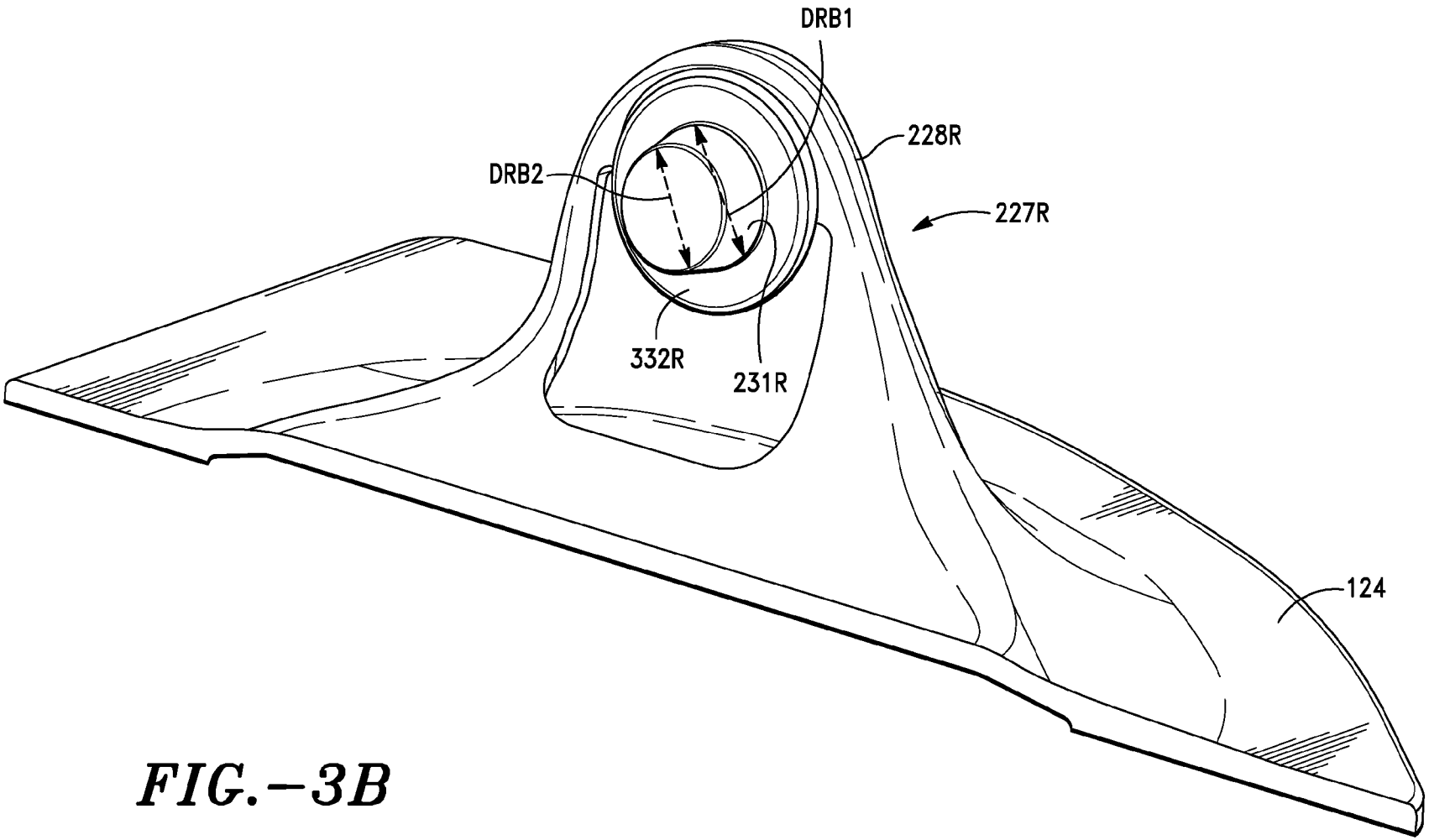
FIG. 3B is a perspective partial view of the cleaning head showing right arm and a right boss.

Handle connector element 227 of head 102 further includes a right boss 230R coupled adjacent the top of right arm 228R. Right boss 230R is another frusto-conically shaped, uniformly tapered shaft-like projection similar to and opposing left boss 230L. Right boss 230R is also directed along its frusto-conical axis (not shown) generally parallel to head upper surface 124 toward left arm 228L and aligned with the frusto-conical axis of left boss 230L. FIG. 3B is a perspective partial view of head 102 showing right arm 228R and right boss 230R. Referring to FIGS. 2, 3B and 4 together, right boss 230R has a right boss outer diameter DRB1 (FIG. 3B) at the cone segment end of right boss 230R where right boss 230R is coupled to right arm 228R. Right boss 230R further has a right boss inner diameter DRB2 (FIG. 3B) at the uncoupled free cone segment end of right boss 230R opposite the cone segment end of right boss 230R coupled to right arm 228R. As shown, right boss outer diameter DRB1 is greater than right boss inner diameter DRB2. Thus, right boss 230R also defines a frusto-conical segment having a right boss exterior surface right boss exterior surface 231R tapered at a right boss draft angle $\alpha$RB. There is also a right boss length YRB, which measures the axial length of right boss 230R, i.e., the distance between the coupled and free ends of right boss 230R.

Handle connector element 227 further includes a right boss base surface 332R adjacent to and circumscribing the cone segment end of right boss 230R that is coupled to right arm 228R. Right boss base surface 332R is also formed as a planar surface in the shape of a flat ring facing inwardly toward left arm 228L, and generally along the same course as the conical axis of right boss 230R. There is a boss spacing distance XB, which measures the distance between right boss base surface 332R of right arm 228R and left boss base surface 332L of left arm 228L. Further, as described more fully with respect to FIG. 7, in one embodiment, right boss outer diameter DRB1 of right boss 230R is greater than left boss outer diameter DLB1 of left boss 230L and right boss inner diameter DRB2 of right boss 230R is greater than left boss inner diameter DLB2 of left boss 230L.

Figure 5B:
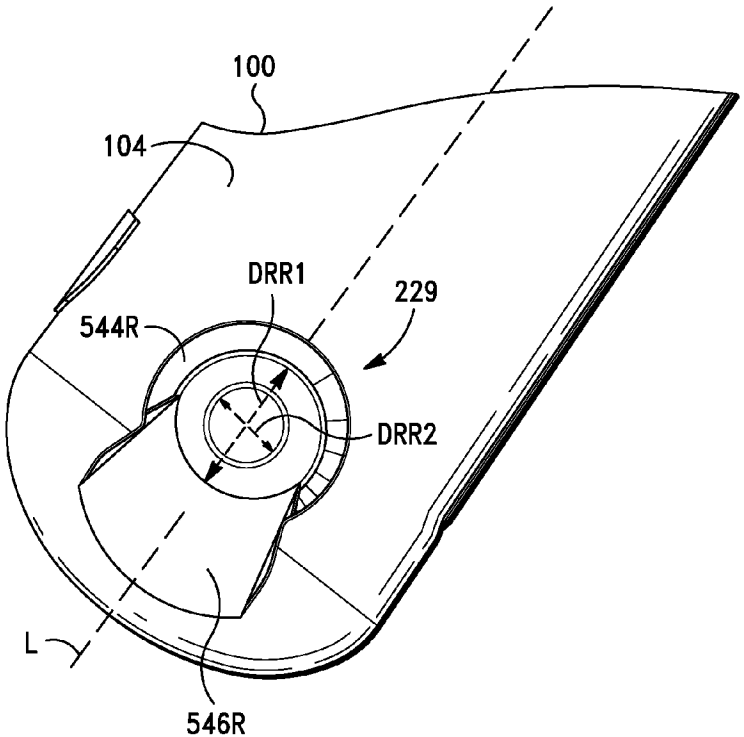
FIG. 5B is a partial view of the right side of the handle.
Figure 5A:
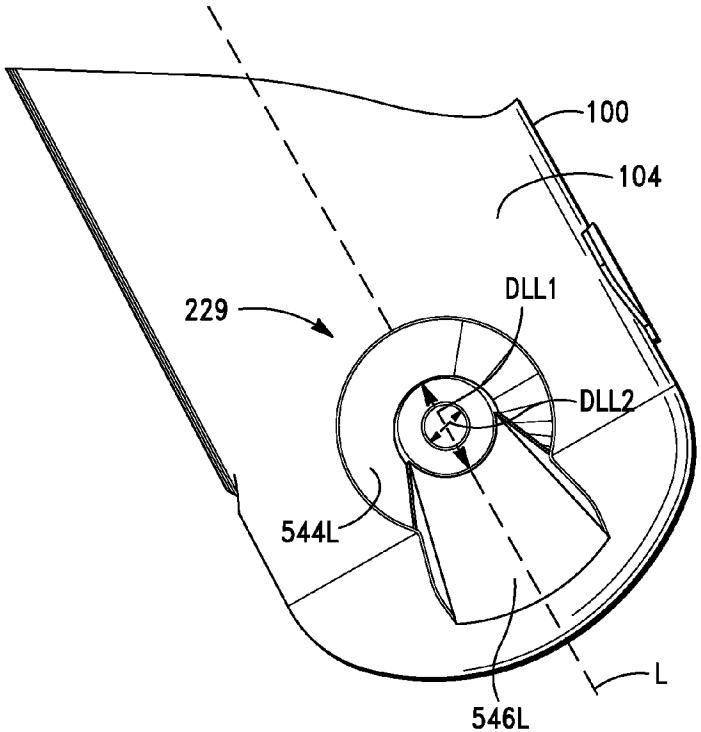
FIG. 5A is a partial view of the left side of the handle.
Figure 6:
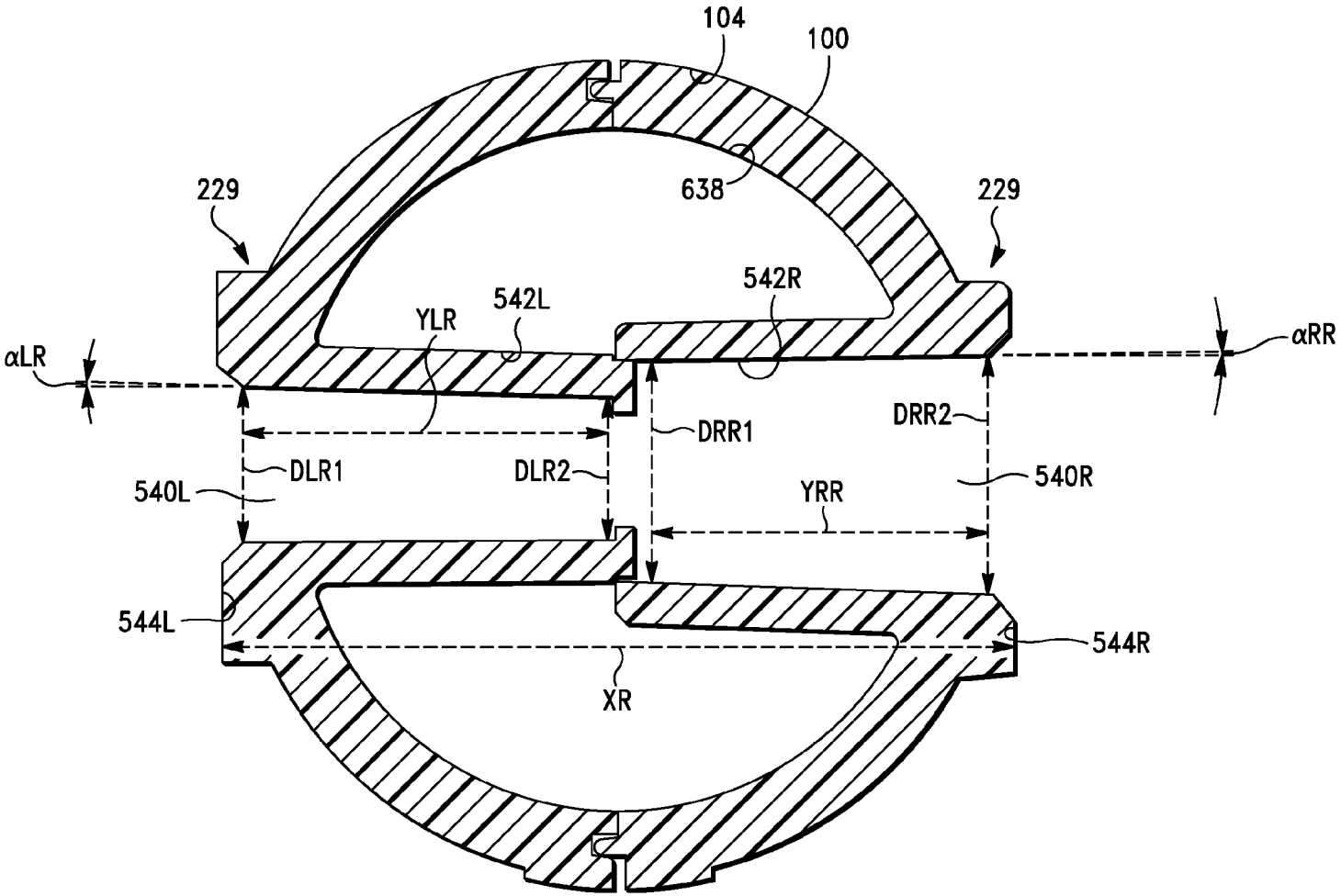
FIG. 6 is a cross-sectional view of the handle taken along 6'_ 6' of FIG. 2.

FIG. 5A is a partial view of the left side of handle 100. FIG. 6 is a cross-sectional view of handle 100 taken along 6'_ 6' of FIG. 2. Referring to FIGS. 2, 5A and 6 together, in one embodiment, head connector element 229 (FIG. 2) of handle 100 includes a left receiver 540L configured as aperture through handle 100 from handle inside surface 638 to handle outside surface 104. Left receiver 540L is adapted to receive left boss 230L (FIG. 3A and 6) of head 102 and to accommodate rotation of left boss 230L within left receiver 540L. In one embodiment left receiver 540L is configure to reject right boss 230R (FIG. 3B and 6) of head 102.

More particularly, the interior edge surface of left receiver 540L defines a conically shaped, uniformly tapered left receiver interior surface 542L. Left receiver interior surface 542L defines a left receiver outer diameter DLR1 at one opening of left receiver 540L adjacent handle outside surface 104 of handle 100 and a left receiver inner diameter DLR2 at the opposite opening of left receiver 540L adjacent handle inside surface 638 of handle 100. In one embodiment, left receiver outer diameter DLR1 is greater than left receiver inner diameter DLR2. Thus, left receiver interior surface 542L has a left receiver draft angle $\alpha$LR with respect to its conical surface axis (not shown) and tapers inwardly from handle outside surface 104 to handle inside surface 638. Further, left receiver interior surface 542L is directed along its conical surfaced axis generally parallel to head upper surface 124, when head 102 is pivotably attached to handle 100 in accordance with the principles of the present invention. There is also a left receiver depth YLR, which measures the axial depth of left receiver 540L, i.e., the distance between the openings of left receiver 540L.

Head connector element 229 further includes a left receiver bottoming surface 544L adjacent to and circumscribing left receiver 540L at handle outside surface 104 of head end portion 110 of handle 100. Left receiver bottoming surface 544L is formed as a planar surface, in the shape of a flat ring, facing outwardly away from handle outside surface 104, and generally along the same course as the conical axis of left receiver interior surface 542L.

FIG. 5B is a partial view of the right side of handle 100. In a similar manner, referring to FIGS. 2, 5B and 6 together, in one embodiment, head connector element 229 (FIG. 2) of handle 100 includes a right receiver 540R configured as aperture through handle 100 from handle inside surface 638 to handle outside surface 104. Right receiver 540R is adapted to receive right boss 230R (FIGS. 3B and 6) of head 102 and to accommodate rotation of left boss 230L within left receiver 540L.

More particularly, the interior edge surface of right receiver 540R defines a conically shaped, uniformly tapered right receiver interior surface 542R. Right receiver interior surface 542R defines a right receiver outer diameter DRR2 at one opening of right receiver 540R adjacent handle outside surface 104 of handle 100 and a right receiver inner diameter DRR2 at the opposite opening of right receiver 540R adjacent handle inside surface 638 of handle 100. In one embodiment, right receiver outer diameter DRR2 is greater than right receiver inner diameter DRR1. Thus, right receiver interior surface 542R has a right receiver draft angle $\alpha$RR with respect to its conical surface axis (not shown) and tapers inwardly from handle outside surface 104 to handle inside surface 638. Further, right receiver interior surface 542R is directed along its conical surfaced axis generally parallel to head upper surface 124, when head 102 is pivotably attached to handle 100 in accordance with the principles of the present invention. There is also a right receiver depth YRR, which measures the axial depth of right receiver 540R, i.e., the distance between the openings of right receiver 540R.

Head connector element 229 further includes a right receiver bottoming surface 544R adjacent to and circumscribing right receiver 540R at handle outside surface 104 of head end portion 110 of handle 100. Left receiver bottoming surface 544L is formed as a planar surface, in the shape of a flat ring, facing outwardly away from handle outside surface 104, and generally along the same course as the conical axis of right receiver interior surface 542R. There is a receiver spacing distance XR, which measures the distance between right receiver bottoming surface 544R and left receiver bottoming surface 544L of head connector element 229 of handle 100.

Figure 7:
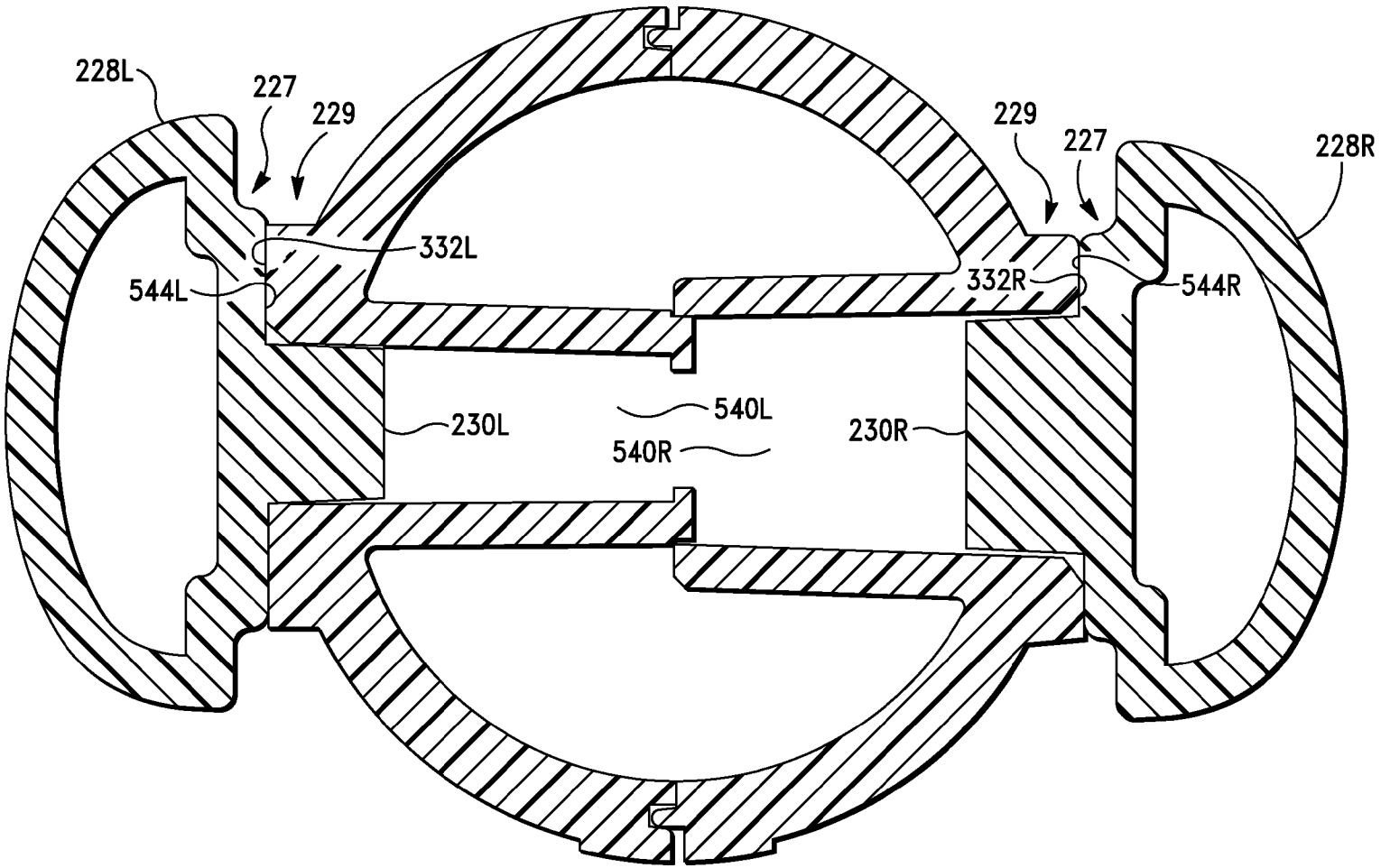
FIG. 7 combines the cross sectional view of the cleaning head in FIG. 4 with the cross-sectional view of the handle of FIG. 6 showing the cooperation of a head connector element of the handle with a handle connector element of the cleaning head for pivotably coupling the cleaning head to the handle.

The operation of the connector elements 227 and 229 for pivotably coupling head 102 to head end portion 110 at handle outside surface 104 of handle 100 and for releasably fixing the pitch of head 102 with respect to handle 100 is next described. FIG. 7 combines the cross sectional view of handle 100 in FIG. 4 with the cross-sectional view of head 102 of FIG. 6 showing the cooperation of head connector element 229 of handle 100 with handle connector element 227 of head 102 for pivotably coupling head 102 to handle 100. Referring to FIGS. 4, 6, and 7 together. At assembly of cleaning implement 10, head 102 is coupled to handle 100 by inserting left boss 230L into left receiver 540L and right boss 230R into right receiver 540R.

In one embodiment, insertion of left boss 230L into left receiver 540L is facilitated by a left slide 546L (FIG. 5A; also shown from front in FIG. 2) on handle outside surface 104 adjacent to and below left receiver 540L. Left slide 546L is a sloped surface that is directed downwardly from left receiver 540L and inwardly toward L of handle 100 away from left receiver 540L. Left slide 546L is adapted to sliding contact with the free end of left boss 230L. Likewise, insertion of right boss 230R into right receiver 540R is facilitated by a right slide 546R (FIG. 5B; also shown from front in FIG. 2) on handle outside surface 104 adjacent to and below right receiver 540R. Right slide 546R is a sloped surface that is directed downwardly from right receiver 540R and inwardly toward L of handle 100 away from right receiver 540R. Right slide 546R is adapted to sliding contact with the free end of right boss 230R.

Figure 8:
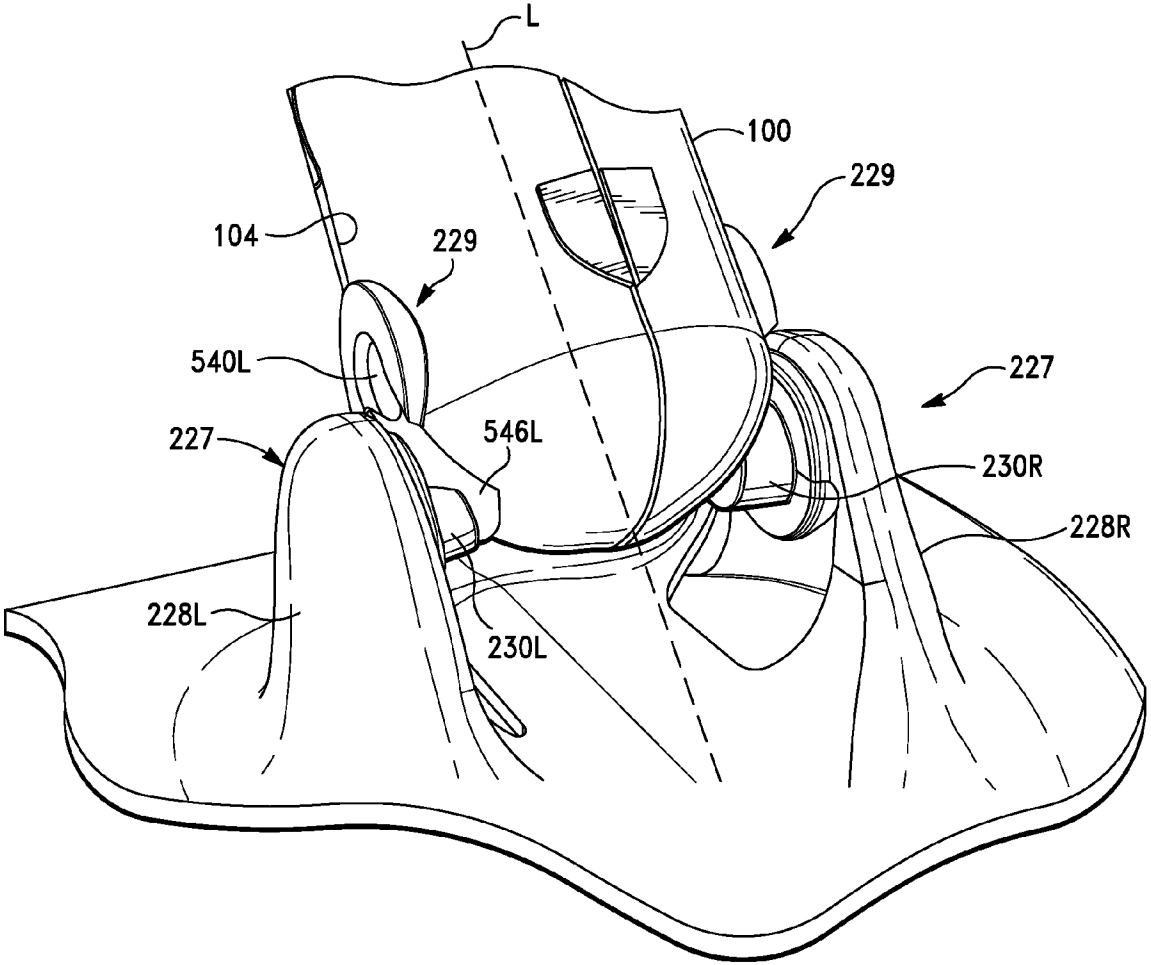
FIG. 8 is a close-up perspective view of the handle with the cleaning head positioned within a left slide and a right slide before coupling of the cleaning head with the handle.

FIG. 8 is a close-up perspective view of handle 100 with head 102 positioned within slides left slide 546L and right slide 546R before coupling of head 102 with handle 100. A user couples head 102 to handle 100 by positioning handle 100 over head 102 such that the free end of left boss 230L contacts left slide 546L below left receiver 540L and the free end of right boss 230R contacts right slide 546R below right receiver 540R, as shown in FIG. 8. As noted, the surfaces of slides left slide 546L and right slide 546R slope inwardly moving down away from left receiver 540L and right receiver 540R respectively. Thus, the lateral distance (not shown) between the surfaces of slides 546L and 546R is the greatest from the point on the surface of left slide 546L adjacent left receiver 540L to the point on the surface of right slide 546R adjacent right receiver 540R. Lateral distances between the surfaces of left slide 546L and right slide 546R at all points below receivers 540L and 540R, respectively, are less since left slide 546L and right slide 546R slope inwardly toward L down from bosses 230L and 230R.

Accordingly, contact of the free ends of bosses 230L and 230R with slides 546L and 546R occurs when head 102 is positioned within slides 546L and 546R such that the distance between the free ends of bosses 230L and 230R equals the lateral distance between the surfaces of slides 546L and 546R.

After contact, a user next pushes handle 100 downward on head 102 forcing left boss 230L and right boss 230R to slide within left slide 546L and right slide 546R respectively. Since the distance between points along left slide 546L and 546R increases with proximity to left receiver 540L and right receiver 540R, respectively, with continued pushing of head 102 onto handle 100, left boss 230L and right boss 230R slide along left slide 546L and right slide 546R, respectively, and both move outwardly away from L of handle 100. The distance between the free ends of bosses 230L and 230R opens up causing boss spacing distance XB to increase and both left arm 228L and right arm 228R to flex away from L of handle 100. The outward flexing of left arm 228L and right arm 228R induces elastic forces biasing left boss 230L and right boss 230R to move inwardly toward L of handle 100. With further pushing and sliding contact, left boss 230L and right boss 230R reach left receiver 540L and right receiver 540R, respectively.

At this point, if left receiver outer diameter DLR1 is selected such that its is greater than left boss inner diameter DLB2, left boss 230L will snap into left receiver 540L, left boss 230L being motivated by the induced elastic force in left arm 228L biasing left boss 230L toward L of handle 100. Likewise, at this point, if right receiver outer diameter DRR1 is selected such that it is greater than right boss inner diameter DRB2, right boss 230R will snap into right receiver 540R, right boss 230R being motivated by the induced elastic force in right arm 228R biasing right boss 230R toward L of handle 100.

In one embodiment, right boss inner diameter DRB2 of right boss 230R is greater than left receiver outer diameter DLR1 of left receiver 540L. Thus, right boss 230R is too large to fit into left receiver 540L since the smallest end, i.e., the free end of right boss 230R does not fit within the largest opening of left receiver 540L adjacent handle outside surface 104. Accordingly, head 102 may not be coupled to handle 100 backwards, i.e. with head point 123 (FIG. 1) pointed in a yawing direction relative to handle 100 opposite the intended direction for cleaning implement 10.

In one embodiment, left boss draft angle αLB equals left receiver draft angle αLR and right boss draft angle αRB equals right receiver draft angle αRR. Further, in this embodiment, left boss length YLB equals left receiver depth YLR and right boss length YRB equals right receiver depth YRR. Finally, in this embodiment, left boss outer diameter DLB1 equals left receiver outer diameter DLR1 and right boss outer diameter DRB1 equals right receiver outer diameter DRR1. Thus, left boss exterior surface 231L is congruent with left receiver interior surface 542L, which allows left boss 230L to be completely inserted within left receiver 540L. When left boss 230L is completely inserted within left receiver 540L, left boss 230L "seats" within left receiver 540L. Said another way, when left boss 230L is completely inserted within left receiver 540L, abutting contacts between left boss exterior surface 231L and left receiver interior surface 542L, and between left boss base surface 332L and left receiver bottoming surface 544L, are established. A frictional force is thus created at the interface between left boss exterior surface 231L and left receiver interior surface 542L and at the interface between left boss base surface 332L and left receiver bottoming surface 544L. Likewise, in this embodiment, right boss exterior surface 231R is congruent with right receiver interior surface 542R allowing right boss 230R to seat completely within right receiver 540R. Further, abutting contacts are established to create frictional forces between left boss exterior surface 231L and left receiver interior surface 542L, and between right boss base surface 332R and right receiver bottoming surface 544R.

If boss spacing distance XB is selected greater then receiver spacing distance XR, after assembly of head 102 onto handle 100, an induced elastic force in arms 228L and 228R remains as arms 228L and 228R are flexed outwardly from L of handle 100 to allow boss spacing distance XB to conform to receiver spacing distance XR. After assembly of head 102 onto handle 100, inwardly biasing elastic force induced in left arm 228L motivates left boss 230L to remain seated in left receiver 540L and to firmly establish abutting contacts between left boss exterior surface 231L and left receiver interior surface 542L, and between left boss base surface 332L and left receiver bottoming surface 544L. Likewise, inwardly biasing elastic force induced in right arm 228R motivates right boss 230R to remain seated in right receiver 540R and to firmly establish abutting contacts between right boss exterior surface 231R and right receiver interior surface 542R, and between right boss base surface 332R and right receiver bottoming surface 544R.

The frictional forces created by the abutting contacts established between left boss exterior surface 231L and left receiver interior surface 542L, and between left boss base surface 332L and left receiver bottoming surface 544L, resists rotation of left boss 230L within left receiver 540L. The abutting contacts established between right boss exterior surface 231R and right receiver interior surface 542R, and between right boss base surface 332R and right receiver bottoming surface 544R, resists rotation of right boss 230R within right receiver 540R. Accordingly, a pitch angle Φ1 (FIG. 9A) of head 102, to which bosses 230L and 230R through respective arms 228L and 228R are coupled, tends to remain fixed relative to handle 100 absent sufficient force applied to head 102 to overcome the frictional forces created.

Accordingly, in use, head 102 may be made to avoid uncontrolled pitching up and down or flopping about front to back of head 102 when cleaning implement 10 is used in a typical cleaning motion. When a user applies cleaning implement 10 to a workpiece surface to be cleaned, by application of force on handle 100 directed toward the work piece surface, head 102 adjusts pitch angle Φ1 (FIG. 9A) to conform to the angle formed by handle 100 and the workpiece surface. When, in a typical cleaning motion, a user removes head 102 from the workpiece surface, the pitch angle at removal remains fixed. As the user typically reapplies head 102 to the workpiece surface, the fixed pitch angle more nearly conforms to the angle between the workpiece surface and handle 100 at reapplication. Thus, the present invention limits stress in the head to handle connection caused by uncontrolled flopping an pitching of head 102.

Figure 9B:
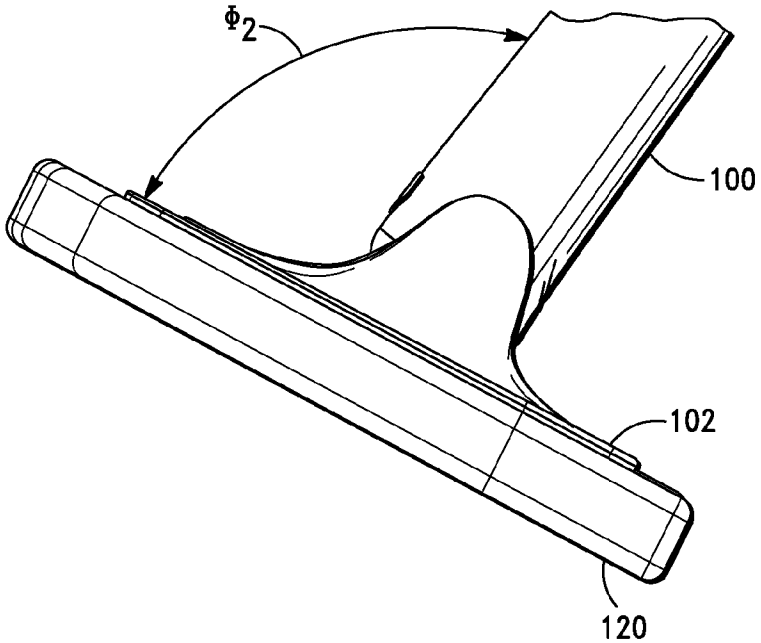
FIGS. 9A and 9B show close-up right side views of the handle with the cleaning head at differing pitch angles.
Figure 9A:
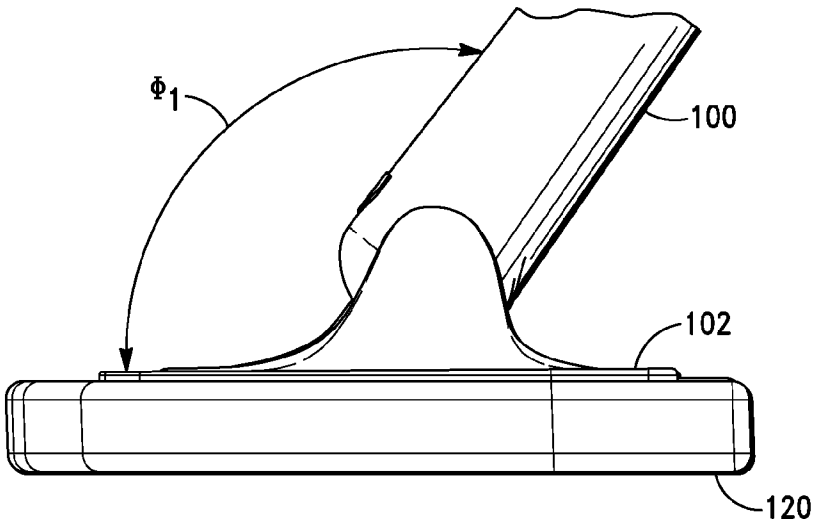

FIGS. 9A and 9B show close-up right side views of handle 100 with head 102 at differing pitch angles. Pitch angle Φ1 of head 102 relative to handle 100 in FIG. 9A remains fixed unless suffice force is applied to head 102, while holding handle 100, to overcome the frictional forces resisting the rotation of bosses 230L and 230R within each boss' respective receiver 540L and 540R. The pitch relationship between head 102 and handle 100 is altered when a user applies sufficient force on head 102, while holding handle 100, to overcome the frictional resistance force created in handle connector elements 227 and 229 of the present invention. For example, in FIG. 9B head 102 has been pitched upwardly to a different pitch angle Φ2 when compared to pitch angle Φ1 of head 102 shown in FIG. 9A.

Further, bosses 230L and 230R cooperate with respective receivers 540L and 540R to preclude either yawing or rolling rotation of head 102 about central axis L of handle, thereby assuring maintenance of any ergonomic features of cleaning implement 10 regarding the rotational relationship of head 102 to handle 100. While, as described above, bosses 230L and 230 R may rotate within respective receivers 540 L and 540R to modify the pitch angle of head 102 to handle 100, the abutting contacts between bosses and receiver precludes relative lateral movement of these components necessary to achieve yawing or rolling of head 102 about central axis L of handle 100.

In other embodiments, while boss draft angles αLB and αRB remain equal to respective receiver draft angles αLR and αRR, boss lengths YLB and YRB, or receiver depths YLR and YRR are lengthened or shortened to alter the frictional forces created at the abutting contacts of bosses 230L and 230R with respective receivers 540L and 540R. In one embodiment, left receiver depth YRR is selected greater than left boss length YLB and right receiver depth YRR selected greater than right boss length YRB. In this embodiment, only the portion of receiver interior surfaces 542L and 542R that abuttingly contact respective boss exterior surfaces 23 IL and 23 IR of the shortened respective boss 230L and 23 OR, contribute to the creation of frictional forces resisting the pitching of head 102 by the rotation of bosses 230L and 230R within respective receivers 540L and 540R.

In other embodiments, inner boss diameters DLB2 and DRB2 and outer diameters DLB1 and DRB1 of respective bosses 230L and 230R are increased or decreased, to adjust the area of abutting contacts of boss exterior surfaces 231L and 231R with respective receiver interior surfaces 231L and 231R to alter the frictional forces created by these structures. Further, the frictional forces resisting created at the abutting contact of left boss base surface 332L with left receiver bottoming surface 544L and of right boss base surface 332R with right receiver bottoming surface 544R may be altered by adjusting the surface area of these ring-like structures.

In one embodiment, left boss outer diameter DLB1 of left boss 230L is somewhat greater than left receiver outer diameter DLR1 of left receiver 540L and right boss outer diameter DRB1 of right boss 230R is somewhat greater than right receiver outer diameter DRR1 of right receiver 540R. In this embodiment, left boss 230L does not fit complete within left receiver 540L even if left boss draft angle αLB equals left receiver draft angle αLR and right boss draft angle αRB equals right receiver draft angle αRR left boss 230L advances within left receiver 540L only to the point where the diameter across left boss exterior surface 231L equals left receiver outer diameter DLR1. Likewise, right boss 230R fits within right receiver 540R only to point where the diameter across right boss exterior surface 231R equals right receiver outer diameter DRR1. In this embodiment, a gap remains between left boss base surface 332L and left receiver bottoming surface 544L and between right boss base surface 332R and right receiver bottoming surface 544R. When head 102 is initially coupled to handle 100 as described above, left boss base surface 332L does not abuttingly contact left receiver bottoming surface 544L and right boss base surface 332R does not abuttingly contact right receiver bottoming surface 544R.

As bosses 230L and 230R and receivers 540L and 540R wear, bosses 230L and 230R fit more deeply within respective receivers 540L and 540R since the span of left receiver outer diameter DLR1 and right receiver outer diameter DRR1 increase with wear. When wear causes left receiver outer diameter DLR1 to equal left boss outer diameter DLB1 and right receiver outer diameter DRR1 to equal right boss outer diameter DRB1, left boss base surface 332L abuttingly contacts left receiver bottoming surface 544L and right boss base surface 332R abuttingly contacts right receiver bottoming surface 544R, respectively. Advantageously, additional frictional force resisting the pitching of head 102 with respect to handle 100 is created to compensate for the loss of frictional force through additional wear of bosses 230L and 230R and receivers 540L and 540R.

In one embodiment, this same compensating friction feature is accomplished by selecting left boss length YLB greater than left receiver depth and by selecting right boss length YRB greater than right receiver depth YRR. In this embodiment, left boss 230L advances within left receiver 540L only to the point where the diameter across left receiver 540L equals left boss inner diameter DLB2. With wear of left receiver 540L at and below the point where the diameter across left receiver 540L equals left boss inner diameter DLB2, left boss 230L advances further within left receiver 540L to the point where left boss base surface 332L abuttingly contacts left receiver bottoming surface 544L as described. In this embodiment, right boss 230R and right receiver 540R operate similarly.

Those of skill in the art will recognize that other variation on the size, and shape of the components making up handle connector element 227 and head connector element 229 are possible. For example, the draft angles of the bosses and respective receivers need not be equal. In these embodiments, only partial abutting contact between the boss exterior surfaces and the receiver interior surface is achieved. Other embodiment provide for boss and receiver shapes that are not conical. For example, hemispherical, parabolic, hyperbolic, or spline curved shapes are possible. Further, the frictional characteristics of the connector elements of the present invention may be adjusted by the selection of a material of construction with different frictional coefficients.

The embodiments herein are illustrated in the context of a cleaning head and a cleaning implement handle for use with a cleaning implement. The skilled artisan will readily appreciate, however, that the structures disclosed have application in a number of other contexts where a head is pivotably coupled to a handle, or where maintenance of an ergonomic design is important.

Finally, this invention has been described herein in considerable detail to provide those skilled in the art with information relevant to apply the novel principles and to construct and use such specialized components as are required. However, it is to be understood that the invention can be carried out by different components, materials and devices, and that various modifications can be accomplished without departing from the scope of the invention itself.

The invention claimed is:

1. A structure comprising:

a handle, said handle having a handle outside surface and a handle inside surface;

a gripper end portion of said handle for grasping said handle outside surface;

a head end portion of said handle opposite said gripper end portion of said handle;

a head having a head upper surface and a head lower surface;

a head connector element adjacent said head end; a handle connector element coupled to said head upper surface, wherein said handle connector element comprises:

a left arm coupled to said head upper surface;

a left boss coupled to said left arm wherein said left boss is configured as a frusto-conical section having a left boss outer diameter, a left boss inner diameter at the end of said left boss coupled to said left arm, a left boss draft angle, and a left boss length;

a right arm opposing said left arm, said right arm being coupled to said head upper surface; and a right boss coupled to said right arm wherein said right boss is configured as a frusto-conical section having right boss outer diameter, and right boss inner diameter at the end of said right boss coupled to said right arm, a right boss draft angle, and a right boss length; and wherein said handle connector element cooperates with said head connector element to pivotably couple said head to said handle, and wherein said head is releasably fixed-in-place at one pitch angle relative to said handle.

2. The structure of claim 1 wherein said head connector element comprises:

a left receiver configured as a aperture at said head end portion of said handle from said handle outside surface to said handle inside surface, said left receiver defining a conically shaped left receiver interior surface having a left receiver outer diameter, a left receiver inner diameter, a left receiver draft angle, and a left receiver depth; and a right receiver configured as a aperture in said head end portion of said handle from said handle outside surface to said handle inside surface, said right receiver defining a conically shaped right receiver interior surface having a right receiver outer diameter, a right receiver inner diameter, a right receiver draft angle, and a right receiver depth.

3. The structure of claim 2 further comprising:

a left boss base surface adjacent to and circumscribing said left boss;

a right boss base surface adjacent to and circumscribing said right boss, wherein said left boss base surface and said right boss base surface define a boss spacing distance therebetween;

a left receiver bottoming surface adjacent to and circumscribing said left receiver; and a right receiver bottoming surface adjacent to and circumscribing said right receiver, wherein said left receiver bottoming surface and said right receiver bottoming surface define a receiver spacing distance therebetween.

4. The structure of claim 3 wherein said receiver spacing distance is greater than said boss spacing distance.

5. The structure of claim 3 wherein:

said left boss draft angle equals said left receiver draft angle; and said right boss draft angle equals said right receiver draft angle.

6. The structure of claim 3 wherein:

said left boss length equals said left receiver depth; and said right boss length equals said right receiver depth.

7. The structure of claim 3 wherein:

said left boss outer diameter equals said left receiver outer diameter; and said right boss outer diameter equals said right receiver outer diameter.

8. The structure of claim 3 wherein:

said left receiver draft angle is greater than said left boss draft angle;

and wherein said right receiver draft angle is greater than said right boss draft angle.

9. The structure of claim 3 wherein:

said left boss length is greater than said left receiver depth; and said right boss length is greater than said right receiver depth.

10. The structure of claim 3 wherein:

said left boss outer diameter is greater than said left receiver outer diameter; and said right boss outer diameter greater than said right receiver outer diameter.

11. The structure of claim 3 wherein said left boss receiver depth is greater than said left boss length, and wherein said right boss receiver depth is greater than said right boss length.

12. The structure of claim 3 wherein said right boss inner diameter is greater than said left receiver outer diameter.

* * * * *